US005202219A

United States Patent [19]

Taniguchi et al.

[11] Patent Number: 5,202,219

[45] Date of Patent: Apr. 13, 1993

[54] IMAGE RECEIVING MATERIAL FOR SILVER COMPLEX DIFFUSION TRANSFER WITH UPPERMOST LAYER

[75] Inventors: Tatsuhito Taniguchi; Hiroaki Nagamatsu; Susumu Baba; Kazuhiko Sunada, all of Nagaokakyo, Japan

[73] Assignee: Mitsubishi Paper Mills Limited, Tokyo, Japan

[21] Appl. No.: 681,710

[22] Filed: Apr. 8, 1991

[30] Foreign Application Priority Data

Apr. 13, 1990 [JP] Japan ..... 2-098653

[51] Int. Cl.[5] ..... G03C 5/54

[52] U.S. Cl. ..... 430/232; 430/227

[58] Field of Search ..... 430/231, 232, 227

[56] References Cited

U.S. PATENT DOCUMENTS

| | | | |
|---|---|---|---|
| 2,732,316 | 1/1956 | July et al. . | |
| 2,983,611 | 5/1961 | Allen et al. . | |
| 3,017,280 | 1/1962 | Yudelson . | |
| 3,103,437 | 9/1963 | Henn et al. . | |
| 3,311,473 | 3/1967 | Foster et al. | 430/232 |
| 3,575,703 | 4/1971 | Judd et al. | 430/232 |
| 3,635,718 | 1/1972 | Froehlich . | |
| 3,849,566 | 8/1989 | De Keyzer | 430/232 |
| 4,056,392 | 11/1977 | Scott | 430/227 |
| 4,376,157 | 3/1983 | Tsubai et al. | 430/229 |

FOREIGN PATENT DOCUMENTS

| | | |
|---|---|---|
| 0306561 | 3/1989 | European Pat. Off. . |
| 2101409 | 7/1971 | Fed. Rep. of Germany . |
| 2065007 | 3/1972 | Fed. Rep. of Germany . |
| 0194344 | 4/1989 | Japan . |

OTHER PUBLICATIONS

German Office Action dated Nov. 6, 1991.

English language translation of German Office Action dated Nov. 6, 1991.

*Primary Examiner*—Richard L. Schilling

*Attorney, Agent, or Firm*—Cushman, Darby & Cushman

[57] ABSTRACT

The present invention provides an image receiving material used for silver complex diffusion transfer process in combination with a photosensitive material. This image receiving material comprises a support and, provided thereon at least an image receiving layer containing physical development nuclei and an uppermost layer containing substantially no physical development nuclei, wherein the uppermost layer contains at least 0.8 $g/m^2$ of hydrophilic colloid in terms of solid content and ratio of solid content of hydrophilic colloid in the uppermost layer to solid content of hydrophilic colloid in the image receiving layer is more than 1.0. Preferably, the image receiving layer contains substantially no hardener and the uppermost layer contains a hardener.

8 Claims, No Drawings

IMAGE RECEIVING MATERIAL FOR SILVER COMPLEX DIFFUSION TRANSFER WITH UPPERMOST LAYER

BACKGROUND OF THE INVENTION

The present invention relates to a silver complex diffusion transfer material which comprises combination of a photosensitive material and an image receiving material and in particular, to construction of layer of an image receiving material.

Silver complex diffusion transfer process generally comprises use of a photosensitive material comprising a support and, provided thereon, a silver halide emulsion layer as a photosensitive layer, an image receiving material comprising a support and, provided thereon, an image receiving layer containing physical development nuclei, and a processing solution containing a silver halide solvent. Principle of the silver complex diffusion transfer process is as follows: The silver halide of exposed area of a photosensitive layer which has been subjected to exposure is developed with a developing agent contained in the processing solution or in the photosensitive material and simultaneously the silver halide of unexposed area reacts with the silver halide solvent to produce a soluble silver complex salt, which diffuses to the image receiving material and precipitates on the physical development nuclei to form a silver image.

The silver complex diffusion transfer process based on such principle is widely used for copying of documents and for block copies in plate making.

Important properties required for image receiving materials used in silver complex diffusion transfer process are that silver image produced has a high density (reflection density and transmission density) and is superior in color tone (bluish black tone is generally desired); diffusion transfer speed is high; and the image receiving layer has a sufficient film strength.

Especially, the density of silver image (reflection density and transmission density) is a very important property. In general, copies are required to have a high definition of image and copies of high definition can be obtained when density of the silver image is high. Furthermore, for block copy materials, high density of silver image is desired in order to satifactorily reproduce image qualities (qualities of fine line and dot).

Furthermore, recently the bluish black color tone of silver image has become important property.

Generally, enhancement of silver image density is attained by increasing content of physical development nuclei, but there is the defect in the case of single layer structure that when amount of physical development nuclei is increased, color tone of silver image becomes reddish or the silver image has metallic luster.

This undesirable color tone of silver image cannot be sufficiently improved by using the known blackening agents such as 1-phenyl-5-mercaptotetrazole and this blackening agent has no effect on improvement of metallic luster. If amount of physical development nuclei is decreased, color tone can be improved, but density of silver image much decreases.

The reddish color tone of silver image and the metallic luster occur due to concentration of physical development nuclai to the surface of the image receiving layer and in the case of single layer structure, physical development nuclei are present on the surface of the image receiving layer, too and therefore, most of the diffused silver complex salt is converted to physically developed silver on the surface of the image receiving layer to result in the abovementioned undesirable color tone of silver image or metallic luster.

As a general means employed in order that physical development nuclei are not present on the surface of the image receiving material, there is a method of using two or more layers as layer construction of the image receiving material and providing a layer containing no physical development nuclei (hereinafter referred to as "uppermost layer") on a layer containing physical development nuclei (hereinafter referred to as "image receiving layer"). This method is disclosed, for example, in Japanese Patent Kokai No. Hei 1-94344.

By providing the uppermost layer, physical development nuclei are not present on the surface and hence, physically developed silver is not concentrated on the surface and metallic luster of silver image can be inhibited.

However, the conventionally employed uppermost layer can inhibit generation of metallic luster, but there are problems that color tone of silver image is inferior or transfer density is not sufficient.

According to further investigation, it has been found that when the image receiving layer of such image receiving material is hardened with a hardener contained therein, silver image becomes continuous silver (metallic silver) at the interface between the image receiving layer and the colloid layer containing no development nuclei and thus, specular silver is formed and so-called Newton's ring is generated between the specular silver and the layer thereon due to interference of light, resulting in considerable deterioration of image quality.

SUMMARY OF THE INVENTION

It has been found that the above defects have been overcome as a result of inventors' investigation on solid content of hydrophilic colloid in the image receiving layer and the uppermost layer and ratio of solid content in the image receiving layer and that in the uppermost layer.

One object of the present invention is to provide an image receiving material which is inhibited from generation of metallic luster and deterioration of color tone and can form a silver image of high density.

The above object has been attained by the image receiving material for silver complex diffusion transfer process which comprises a support which is coated with at least an image receiving layer coating solution containing physical development nuclei and an uppermost layer coating solution containing substantially no physical development nuclei, characterized in that solid content of a hydrophilic colloid in the uppermost layer is at least 0.8 g/m$^2$ and ratio of solid content in the uppermost layer to solid content in the image receiving layer is more than 1.0.

Another object of the present invention is to provide a method for producing an image receiving material for silver complex diffusion transfer process according to which so-called Newton's ring does not occur and besides, specular silver is not formed.

The above object has been attained by the method for producing an image receiving material for silver complex diffusion transfer process which comprises a support, an image receiving layer containing physical development nuclei provided on the support and at least one water-permeable hydrophilic colloid layer containing no physical development nuclei provided on the image receiving layer, characterized in that a coating solution for the image receiving layer contains substantially no hardener and a coating solution for the water-permeable hydrophilic colloid layer contains a hardener.

DESCRIPTION OF THE INVENTION

The present invention will be explained in more detail.

Hitherto, it has been common that the layer called uppermost layer is thinner than the image receiving layer. When the thickness of the uppermost layer increases with increase in the amount of hydrophilic colloid, there may occur the problems that development is hindered or amount of solution absorbed therein increases to give adverse effects on running property and besides, deterioration of image quality occurs because a thick film is present on the image receiving layer.

Contrary to the conventional common knowledge, the inventors have succeeded in production of an image receiving material which is inhibited from occurrence of metallic luster and deterioration of color tone and can form a silver image of high density by adjusting the amount of hydrophilic colloid in the uppermost layer to 0.8 $g/m^2$ or more and increasing the amount of hydrophilic colloid in the uppermost layer than that of hydrophilic colloid in the image receiving layer.

Amount of the hydrophilic colloid (binder) in the uppermost layer is 0.8 $g/m^2$ or more, preferably 1.0 $g/m^2$ or more and upper limit of the amount is 3 $g/m^2$, preferably 2 $g/m^2$. If amount of the binder is more than 3 $g/m^2$, there are problems such as deterioration of running property, reduction of transfer density and deterioration of reproducibility of fine lines.

Amount of binder in the image receiving layer is preferably 0.3–1.5 $g/m^2$, especially 0.5–1.0 $g/m^2$ is preferably 0.3 taking into consideration total amount of binder and coatability.

Weight ratio of the binder in the uppermost layer to that in the image receiving layer is more than 1.0, preferably 1.5–4 and total amount of binder is 1–4 $g/m^2$, preferably 1.5–3.0 $g/m^2$.

The uppermost colloid layer and the image receiving layer can be hardened with suitable hardeners. Examples of the hardener are aldehyde compounds such as formaldehyde and glutaraldehyde; ketone compounds such as diacetyl and cyclopentanedione; bis(2-chloroethylurea)-2-hydroxy-4,6-dichloro-1,3,5-triazine; compounds having reactive halogens as disclosed in U.S. Pat. No. 3,288,775; divinyl sulfone; compounds having reactive olefins as disclosed in U.S. Pat. No. 3,635,718; N-methylol compounds as disclosed in U.S. Pat. No. 2,732,316; isocyanates as disclosed in U.S. Pat. No. 3,103,437; aziridine compounds as disclosed in U.S. Pat. Nos. 3,017,280 and 2,983,611; carbodiimide compounds as disclosed in U.S. Pat. No. 3,100,704; epoxy compounds as disclosed in U.S. Pat. No. 3,091,537; halogen carboxyaldehydes such as mucochloric acid; dioxane derivatives such as dihydroxydioxane; and inorganic hardeners such as chromium alum, potash alum and zirconium sulfate. These may be used alone or in combination of two or more. Among these hardeners, preferred are low molecular diffusible hardeners and especially preferred are aldehyde type, triazine type and vinyl sulfone type hardeners.

This consideration can be developed to the preferred embodiment of the present invention where only the uppermost colloid layer contains hardener and the image receiving layer contains substantially no hardener.

Amount of the hardener used should be calculated based on total amount of gelatin and can be minimum amount by which necessary hardening level is attained and can be freely chosen depending on use. Usually, it is about 0.02–0.2 mM for 1 g of gelatin.

The expression "coating solution for image receiving layer contains substantially no hardener" employed here includes not only "containing utterly no hardener", but also "containing hardener in such a small amount that attainment of the object of the present invention is not damaged".

A plurality of hydrophilic colloid layers can be coated separately or simultaneously. Coating can be carried out by any known methods.

The physical development nuclei used in the image receiving layer of image receiving materials of the present invention include, for example, noble metals such as silver, gold, platinum, palladium, copper, cadmium, lead, cobalt, and nickel, and sulfides and selenides thereof. These are preferabaly in the form of colloid.

The image receiving layer may contain surface active agents (for example, natural surface active agents such as saponin; nonionic surface active agents such as alkylene oxide type, glycerin type, and glycidol type; cationic surface active agents such as higher alkylamines, quaternary ammonium salts, pyridine and other heterocyclic compounds, and sulfonium salts; anionic surface active agents containing acid groups such as carboxylic acid, sulfonic acid, phosphoric acid, sulfuric acid ester and phosphoric acid ester groups; amphoteric surface active agents such as amino acids, aminosulfonic acids, and sulfuric acid or phosphoric acid esters of amino alcohols; and fluorine type anionic and amphoteric surface active agents containing fluorine), matting agents, fluorescent dyes, discoloration inhibitors, color toning agents (for example, 1-phenyl-5-mercaptotetrazole and other toning agents as mentioned in "Photographic Silver Halide Diffusion Process", page 61, published from Focal Press), developing agents (for example, hydroquinone and derivatives thereof and 1-phenyl-3-pyrazolidone and derivatives thereof), silver halide solvents (for example, sodium thiosulfate, ammonium thiosulfate, sodium thiocyanate and potassium thiocyanate), and the like. Furthermore, an over layer (for example, lime-treated gelatin, acid-treated gelatin, hydroxyethyl cellulose, carboxymethyl cellulose, pullulan, and sodium alginate) may be provided on the image receiving layer and an neutralizing layer and a subbing layer for improving adhesion to a support may be provided below the image receiving layer.

As the support, there may be used any supports, for example, polyolefin resin films such as polyethylene and polypropylene films and papers covered with these films. The surface of the supports is preferably roughened by any roughening methods such as press molding by a roughened body. The roughness is preferably about 2–about 20 μm in depth which is a distance between the bottom and the peak of surface irregularities and about 5–about 100 μm in distance between peaks. Since the roughened surface per se is hydrophobic, this is usually subjected to hydrophilization treatments such as corona discharge treatment and subbing treatment. The resin may contain white pigments, fluorescent dyes, antistatic agents and the like.

Silver halide emulsions used in the photosensitive layer of the photosensitive materials for silver complex diffusion transfer process according to the present invention are those which are commonly used for the diffusion transfer process. Composition of the emulsion has no special limitation and there may be used any emulsions in which the silver salt has the ability to be developed in the exposed area and to be diffused in the unexposed area at a speed necessary for diffusion transfer process, respectively. As examples thereof, mention may be made of silver bromide, silver iodide, silver chloride, silver chlorobromide, silver iodobromide, silver chloroiodide and mixtures thereof. These may be subjected to usual chemical sensitization and spectral sensitization. As binders for the photosensitive layer, there may be used polymeric materials normally used for preparation of silver halide emulsions such as lime-treated gelatin, acid-treated gelatin, phthalated gelatin, acylated gelatin, phenylcarbamylated gelatin, polyvinyl alcohol, partially saponified polyvinyl alcohol, polyacrylamide, poly-N-vinylpyrrolidone, hydroxyethyl cellulose, carboxymethyl cellulose, heat processed products of polyvinyl alcohol and maleic anhydride copolymers (for example, styrene-maleic anhydride copolymer and ethylene-maleic anhydride copolymer), and emulsion-polymerized synthetic resins (for example, homopolymers and copolymers of polyacrylic acid esters, polymethacrylic acid esters, acrylic acid, methacrylic acid, polystyrene and polybutadiene).

The photosensitive layer may be hardened with suitable hardeners as referred to for the image receiving layer. Furthermore, the photosensitive layer may contain additives as generally used for silver halide photosensitive materials, such as surface active agents, antifoggants, matting agents, fluorescent dyes, and developing agents (for example, hydroquinone and derivatives thereof and 1-phenyl-3-pyrazolidone and derivatives thereof). Moreover, an over layer (for example, lime-treated gelatin, acid-treated gelatin, hydroxyethyl cellulose, carboxymethyl cellulose, pullulan, and sodium alginate) may be provided on the photosensitive layer and an antihalation layer may be provided under the photosensitive layer.

Processing solution for silver complex diffusion transfer process used in the present invention may be the common silver complex diffusion transfer processing solution. That is, the processing solution may contain a developing agent for developing the exposed silver halide, such as hydroquinone and derivatives thereof and 1-phenyl-3-pyrazolidone and derivatives thereof, a solvent for undeveloped silver halide, such as sodium thiosulfate, ammonium thiosulfate, sodium thiocyanate and potassium thiocyanate, a preservative such as sodium sulfite, a development retardant such as potassium bromide, and a color toning agent such as 1-phenyl-5-mercaptotetrazole.

The following nonlimiting examples will further explain the present invention.

EXAMPLE 1

Physical development nuclei comprising nickel sulfide and silver sulfide were prepared in a 1% aqueous solution of gelatin by reacting nickel nitrate, silver nitrate and sodium sulfide in equimolar amounts. On one side of a paper support of 110 g/m$^2$ coated with polyethylene on both sides was coated the abovementioned gelatin containing the nuclei as an image receiving layer at 0.6 g/m$^2$ in terms of dry weight of the hydrophilic colloid (Sample A-0) and at 0.9 g/m$^2$ in terms of dry weight of the hydrophilic colloid (Sample B-0). These image receiving materials had only the image receiving layer.

Furthermore, on the image receiving layer of the above samples was coated an aqueous solution of gelatin which contained no nuclei as an uppermost layer at 0.4 g/m$^2$ (Samples A-1, B-1), at 0.6 g/m$^2$ (Samples A-2, B-2), at 0.8 g/m$^2$ (Samples A-3, B-3), at 1.0 g/m$^2$ (Samples A-4, B-4), at 1.2 g/m$^2$ (Samples A-5, B-5), and at 2.0 g/m$^2$ (Samples A-6, B-6) in terms of dry weight of the hydrophilic colloid.

A photosensitive material was prepared in the following manner: An undercoat layer containing carbon black for antihalation was provided on a polyethylene laminated paper. Thereon was provided a gelatino silver halide emulsion layer containing 1.5 g/m$^2$ (in terms of silver nitrate) of orthochromatically sensitized silver chlorobromide (silver bromide 5 mol%) of 0.35 $\mu$ in average grain size, 0.2 g/m$^2$ of 1-phenyl-3-pyrazolidone, 0.7 g/m$^2$ of hydroquinone, and 4 g/m$^2$ of gelatin. The silver halide emulsion layer was hardened with a hardener contained therein in such a manner that the diffusion transfer processing was not hindered.

A diffusion transfer processing solution having the following composition was used.

| | |
|---|---|
| Water | 800 ml |
| Sodium hydroxide | 25 g |
| Anhydrous sodium sulfite | 100 g |
| Hydroquinone | 20 g |
| 1-Phenyl-3-pyrazolidone | 1 g |
| Potassium bromide | 3 g |
| Sodium thiosulfate | 30 g |
| 1-Phenyl-5-mercaptotetrazole | 0.1 g |
| Water to make up 1000 ml. | |

The thus obtained photosensitive material was subjected to correct exposure by a process camera using an original having suitable black portions. Then, the surface of the emulsion layer of this photosensitive material was brought into close contact with the surface of the image receiving material and these materials in this state were passed through a processor containing the abovementioned diffusion transfer processing solution and having a squeeze rollers and these were separated from each other after 30 seconds after they left the squeeze rollers. The image receiving material was washed with water for about 30 seconds and then dried and reflection density of black portion was measured by RD 519 reflection densitometer manufactured by Macbeth Co.

In the following Tables 1 and 2, the marks which show the results of evaluation of metallic luster, color tone and running property have the following meanings.

◎ : Excellent
○ : Good
Ⓐ : Fairly good
Δ : Somewhat bad
x: Bad

TABLE 1

(Amount of binder in the image receiving layer: 0.6 g/m²)

| Sample | Amount of gelatin in the uppermost layer | Reflection density | Metallic luster | Color tone | Running property | |
|---|---|---|---|---|---|---|
| A-0 | — | 1.65 | x | x | ○ | Comparative |
| A-1 | 0.4 | 1.72 | x | x | ○ | " |
| A-2 | 0.6 | 1.72 | x | x | ○ | " |
| A-3 | 0.8 | 1.75 | Ⓐ | Δ | ○ | The present invention |
| A-4 | 1.0 | 1.78 | ○ | ○ | ○ | " |
| A-5 | 1.2 | 1.85 | ◎ | ◎ | ○ | " |
| A-6 | 2.0 | 1.78 | ◎ | ◎ | Ⓐ | " |

TABLE 2

(Amount of binder in the image receiving layer: 0.9 g/m²)

| Sample | Amount of gelatin in the uppermost layer | Reflection density | Metallic luster | Color tone | Running property | |
|---|---|---|---|---|---|---|
| B-0 | — | 1.67 | x | x | ○ | Comparative |
| B-1 | 0.4 | 1.70 | x | x | ○ | " |
| B-2 | 0.6 | 1.72 | x | x | ○ | " |
| B-3 | 0.8 | 1.80 | Δ | Δ | ○ | " |
| B-4 | 1.0 | 1.86 | ○ | ○ | ○ | The present invention |
| B-5 | 1.2 | 1.85 | ◎ | ◎ | ○ | " |
| B-6 | 2.0 | 1.71 | ◎ | ◎ | Ⓐ | " |

It can be seen from the results of Table 1 and Table 2 that generation of metallic luster was hindered and color tone was improved and besides, reflection density increased because the image receiving material had the uppermost layer and amount of gelatin in the uppermost layer was larger than that of gelatin in the image receiving layer and was 0.8 g/m² or more.

EXAMPLE 2

The similar results to those of Example 1 were obtained when the above Samples A–F were processed with an activator type processing solution.

EXAMPLE 3

Example 1 was repeated except that palladium sulfide was used as the physical development nuclei of the Samples A–F. The similar results to those of Example 1 were obtained.

EXAMPLE 4

Example 1 was repeated except that 1-phenyl-5-mercaptotetrazole was added to the Samples A–F. The similar results to those of Example 1 where obtained.

Next, preferred examples of the present invention where the coating solution for image receiving layer contained substantially no hardener are shown as image receiving materials 1–6.

A photosensitive material was prepared in the following manner: An undercoat layer containing carbon black for antihalation was provided on a polyethylene laminated paper and thereon was provided a gelatino silver halide emulsion layer containing 1.5 g/m² (in terms of silver nitrate) of orthochromatically sensitized silver chlorobromide (silver bromide 5 mol%) of 0.3 μ in average grain size, 0.2 g/m² of 1-phenyl-3-pyrazolidone, 0.7 g/m² of hydroquinone and 4 g/m² of gelatin.

The silver halide emulsion layer was hardened with a hardener contained therein in such a manner that the diffusion transfer processing was not retarded.

The image receiving material was prepared in the following manner: The following coating solution was prepared and was coated at a solid content of 0.8 g/m² on a polyethylene laminated paper of 90 g/m² previously subjected to corona discharge treatment and was dried.

| | |
|---|---|
| Binder | 10 g |
| Water | 320 ml |
| Nickel sulfide colloid solution (5 mM/l) | 50 ml |
| Hardener | 3 ml |
| Sodium dodecylbenzenesulfonate (5% aqueous solution) | 15 ml |
| | (Totally 400 g) |

The following coating solution was applied at a solid content of 1.2 g/m² at the dry state to the dried image receiving layer.

| | |
|---|---|
| Binder | 15 g |
| Water | 250 ml |
| 1-Phenyl-5-mercaptotetrazole (1% methyl alcohol solution) | 10 ml |
| Hardener | 4 ml |
| Sodium dodecylbenzenesulfonate (5% aqueous solution) | 10 ml |
| | (Totally 300 g) |

The resulting sample was moisture conditioned at 70% RH for 2 hours and then, heated at 40° C. for 7 days.

The following diffusion transfer processing solution was used.

| | |
|---|---|
| Water | 800 ml |
| Sodium hydroxide | 25 g |
| Anhydrous sodium sulfite | 100 g |
| Hydroquinone | 20 g |
| 1-Phenyl-3-pyrazolidone | 1 g |
| Potassium bromide | 3 g |
| Sodium thiosulfate | 30 g |
| 1-Phenyl-5-mercaptotetrazole | 0.1 g |
| Water to make up 1,000 ml | |

The thus obtained photosensitive material was exposed imagewise. Then, the surface of the emulsion layer of the photosensitive material and the surface of the image receiving material were brought into close contact with each other and these were passed through a processor containing the above diffusion transfer processing solution and having squeeze rollers and were separated from each other after 30 seconds after they left the squeeze rollers.

The image receiving material was washed with water for about 30 seconds and then dried and reflection density of black portion was measured by RD 519 reflection densitometer of Macbeth Co.

State of specular silver of transfer image and size of interference fringe of Newton's ring were evaluated by visual observation.

The above process of formation of transfer image was repeated several times except that the binder and the hardener as shown in the following Table 3 were used in the image receiving layer and the water-permeable hydrophilic colloid layer. The hardenr A was 2,4-dichloro-6-hydroxy-S-triazine sodium salt (5% aqueous solution) and the hardener B was formalin (5% aqueous solution).

TABLE 3

| Image receiving material | Image receiving layer | | Hydrophilic colloid layer | |
|---|---|---|---|---|
| | Binder | Hardener | Binder | Hardener |
| 1 | Gelatin | A | Gelatin | A |
| 2 | Gelatin 50% Dextran 50% | B | Gelatin | B |
| 3 | Gelatin | A | Gelatin 50% Hydroxyethyl cellulose 50% | A |
| 4 | Gelatin | Non | Gelatin | A |
| 5 | Gelatin Dextran 50% | Non | Gelatin | B |
| 6 | Gelatin | Non | Gelatin 50% Hydroxyethyl cellulose 50% | A |

The results are shown in the following Table 4.

TABLE 4

| Image receiving material | Reflection density | Specular silver | Interference fringe | |
|---|---|---|---|---|
| 1 | 1.75 | Non | Large | Comparative |
| 2 | 1.59 | Non | Large | " |
| 3 | 1.63 | Considerable | Medium | " |
| 4 | 1.82 | Non | Non | The present invention |
| 5 | 1.71 | Non | Non | The present invention |
| 6 | 1.65 | Slight | Non | The present invention |

It is clear from Table 4 that the image receiving materials 4–6 of the present invention have excellent photographic properties.

What is claimed is:

1. An image receiving material for silver complex diffusion transfer process which comprises a support and, provided thereon, at least an image receiving layer containing physical development nuclei and an uppermost layer containing substantially no physical development nuclei, wherein the uppermost layer contains at least 0.8 $g/m^2$ of hydrophilic colloid in terms of solid content;

and wherein ratio of solid content of hydrophilic colloid in the uppermost layer to solid content of hydrophilic colloid in the image receiving layer is more than 1.0;

and wherein the image receiving layer contains substantially no hardener and the uppermost layer contains a hardener.

2. An image receiving material according to claim 1, wherein solid content of the hydrophilic colloid in the uppermost layer is 0.8–2 $g/m^2$;

and wherein solid content of the hydrophilic colloid in the image receiving layer is 0.5–1 $g/m^2$;

and wherein total amount of the hydrophilic colloid in the uppermost layer and the image receiving layer is 1–$g/m^2$.

3. An image receiving material according to claim 1, wherein solid content of the hydrophilic colloid in the uppermost layer is 0.8–3 $g/m^2$.

4. An image receiving material according to claim 1, wherein solid content of the hydrophilic colloid in the image receiving layer is 0.3–1.5 $g/m^2$.

5. An image receiving material according to claim 1, wherein the ratio of the solid content of the hydrophilic colloid in the uppermost layer to the solid content of the hydrophilic colloid in the image receiving layer is 1.5–4.

6. An image receiving material according to cliam 1, wherein total amount of the hydrophilic colloid in the uppermost layer and the image receiving layer is 1–4 $g/m^2$.

7. An image receiving material according to claim 1, wherein the hardener is an aldehyde type, triazine type or vinyl sulfone type hardener.

8. An image receiving material according to claim 1, wherein amount of the hardener is 0.02—0.2 mmol per 1 g of gelatin.

* * * * *